US008376801B2

(12) United States Patent
Nguyen Hoang et al.

(10) Patent No.: US 8,376,801 B2
(45) Date of Patent: Feb. 19, 2013

(54) LUMINESCENT COMPONENT AND MANUFACTURING METHOD

(75) Inventors: Viet Nguyen Hoang, Leuven (BE); Radu Surdeanu, Roosbeek (BE); Benoit Bataillou, Lyons (FR)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 12/922,127

(22) PCT Filed: Mar. 9, 2009

(86) PCT No.: PCT/IB2009/050963

§ 371 (c)(1),
(2), (4) Date: Jan. 14, 2011

(87) PCT Pub. No.: WO2009/113003

PCT Pub. Date: Sep. 17, 2009

(65) Prior Publication Data

US 2011/0103039 A1 May 5, 2011

(30) Foreign Application Priority Data

Mar. 13, 2008 (EP) ..... 08102588

(51) Int. Cl.
*H01J 9/24* (2006.01)

(52) U.S. Cl. ..... 445/23; 445/53; 445/58; 313/483; 313/498; 313/501; 313/504; 362/84; 362/101; 362/249.02

(58) Field of Classification Search ..... 313/498, 313/504, 501, 483; 445/23, 53, 58; 326/84, 326/101, 249.02
See application file for complete search history.

(56) References Cited

U.S. PATENT DOCUMENTS

| | | | | |
|---|---|---|---|---|
| 5,294,869 | A * | 3/1994 | Tang et al. | 313/504 |
| 5,614,435 | A * | 3/1997 | Petroff et al. | 117/85 |
| 5,869,929 | A * | 2/1999 | Eida et al. | 313/501 |
| 6,221,194 | B1 | 4/2001 | Watanabe et al. | |
| 6,242,326 | B1 * | 6/2001 | Ro et al. | 438/493 |
| 6,344,712 | B1 * | 2/2002 | Eida et al. | 313/504 |
| 6,608,439 | B1 * | 8/2003 | Sokolik et al. | 313/512 |
| 6,967,112 | B2 * | 11/2005 | Maa et al. | 438/14 |

(Continued)

FOREIGN PATENT DOCUMENTS

| | | |
|---|---|---|
| EP | 0550062 A2 | 7/1993 |
| EP | 0606093 A2 | 7/1994 |

(Continued)

OTHER PUBLICATIONS

Reed, M. A., et al; "Observation of Discrete Electronic States in a Zero-Dimensional Semiconductor Nanostructure"; Physical Review Letters, vol. 60, No. 6; pp. 535-538 (Feb. 8, 1998).

(Continued)

*Primary Examiner* — Nimeshkumar Patel
*Assistant Examiner* — Thomas A Hollweg

(57) ABSTRACT

The present invention relates to a luminescent component (30) and a manufacturing method thereof. The luminescent component (30) comprises a first transparent carrier (18), a second transparent carrier (24), a substrate (10) sandwiched between said transparent carriers (18; 24), the substrate (10) comprising a conduit from the first transparent layer (18) to the second transparent carrier (24), the conduit being filled with a luminescent solution (20). This facilitates the use of colloidal solutions of quantum dots in such a luminescent component (30). Preferably, the substrate (10) is direct bonded to the transparent carriers (18, 24) using direct wafer bonding techniques.

11 Claims, 3 Drawing Sheets

U.S. PATENT DOCUMENTS

Figure 1A:
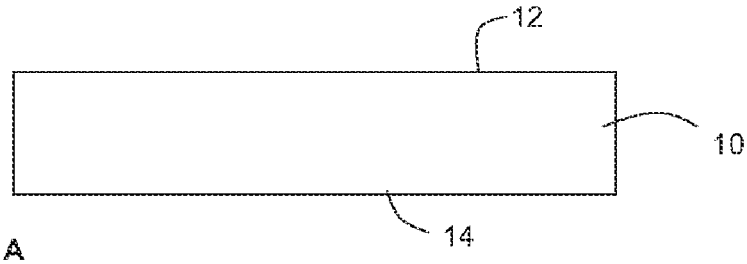

| | | | | |
|---|---|---|---|---|
| 7,375,461 | B2 * | 5/2008 | Birnstock et al. | 313/504 |
| 2003/0127659 | A1 * | 7/2003 | Bawendi et al. | 257/89 |
| 2004/0169464 | A1 * | 9/2004 | Birnstock et al. | 313/504 |
| 2005/0082554 | A1 | 4/2005 | Torvik | |
| 2005/0196894 | A1 | 9/2005 | Maa et al. | |
| 2005/0282975 | A1 * | 12/2005 | Haitko et al. | 525/476 |
| 2006/0071593 | A1 * | 4/2006 | Tan et al. | 313/512 |
| 2007/0015341 | A1 * | 1/2007 | Ouellet et al. | 438/456 |
| 2007/0048896 | A1 * | 3/2007 | Andry et al. | 438/106 |
| 2007/0057274 | A1 | 3/2007 | Yang et al. | |
| 2008/0237540 | A1 * | 10/2008 | Dubrow | 252/301.6 S |
| 2009/0002806 | A1 * | 1/2009 | Skipor et al. | 359/296 |
| 2009/0127690 | A1 * | 5/2009 | Jaducana et al. | 257/690 |
| 2009/0296368 | A1 * | 12/2009 | Ramer | 362/84 |

FOREIGN PATENT DOCUMENTS

| | | | |
|---|---|---|---|
| EP | 0767599 | A2 | 4/1997 |
| EP | 1798783 | A2 | 6/2007 |
| WO | 96/41501 | A1 | 12/1996 |
| WO | 2005/038882 | A2 | 4/2005 |
| WO | 2007/012992 | A1 | 2/2007 |

OTHER PUBLICATIONS

Sandia; "Wireless Nanocrystals Efficiently Radiate Visible Light"; 2 Pages; (Jun. 22, 2004).

Xu, Jian, et al; "Microcavity Light-Emitting Devices Based on Colloidal Semiconductor Nanocrystal Quantum Dots"; IEEE Photonics Technology Letters, vol. 17, No. 10; pp. 2008-2010; (Oct. 2005).

Pagan, et al; "Colloidal Quantum Dot Active Layers for Light Emitting Diodes"; IEEE Semiconductor Device Research Symposium; pp. 93-94; Dec. 7-9, 2005.

Vallapil, N., et al; "Solution Processed Micro-Cavity Structures—Fundamentals and Applications"; pp. 184-188 (2007).

Song, Hongioo, et al; "Red Light Emitting Solid State Hybrid Quantum Dot-Near GaN LED Devices"; Nanotechnology 18; pp. 1-4; 255202; (2007).

Tang, Ai-Wei; et al; "White Light Emission From Organic-Inorganic Hererostructure Devices by Using CdSe Quantum Dots as Emitting Layer"; Journal of Luminescence 122-123; pp. 649-651; (2007).

International Search Report and Written Opinion for Application PCT/IB2009/050963 (Mar. 9, 2009).

http://www.chemie.uni-hamburg.de/pc/weller/, Date of print-out submitted Sep. 14, 2012.

* cited by examiner

LUMINESCENT COMPONENT AND MANUFACTURING METHOD

Optical elements for emitting light in a first spectral range in response to a light stimulus in a further spectral range, i.e. luminescent optical components, have attracted a considerable amount of attention, because of their applicability in a number of application domains such as solid state lighting and display applications. Such optical elements may effectively be used as color filters or light sources in their own right.

In particular, semiconductor quantum dot based optical elements have attracted considerable attention because the confinement structure of the quantum dots facilitates the generation of light in a well-defined spectral range. This is because the confinement structure limits the band gap of the particle such that the quantized nature of the particle excitation energies becomes more pronounced.

US patent application No. 2007/0057274 A1 discloses a luminescent component comprising silicon quantum dots, which is capable of generating white light. The quantum dots are embedded in a silicon nitride film, which is deposited over the surface of a transparent substrate. A light emitting device is deposited over the silicon nitride film.

US patent application No. 2005/0082554 A1 discloses a direct wafer-bonded light emitting semiconductor device including an array of indirect band gap material quantum dots. The quantum dots are sandwiched between an n-type semiconductor cladding layer and a p-type semiconductor cladding layer.

European patent application No. 1 798 783 A2 discloses three-dimensional light emitting device comprising a substrate having a three-dimensional recess, wherein the surface of the recess is coated with a dispersion of nanoparticles and subsequently dried. The nanoparticles are adsorbed to the recess surface by charging the surface of the recess and charging the nanoparticles with an opposite charge.

J. Pagan et al. in 'Colloidal quantum dot active layers for light emitting diodes', IEEE Semiconductor Device Research Symposium, 2005 Dec. 7-9, pages 93-94, disclose that size control of a quantum dot facilitates tuning the emission wavelength range of the quantum dot. A light emitting diode comprising a colloidal quantum dot layer embedded in a GaN heterostructure. The colloidal quantum dot layer is deposited in solution over an n-type GaN layer and subsequently capped at low temperature with an intrinsic GaN layer to protect the quantum dots from the subsequent high temperature p-type GaN layer growing step.

N. Vallapil et al. in 'Solution processed micro-cavity structures with embedded quantum dots', Photonics and nanostructures—fundamentals and applications, 5, 2007, pages 184-188 disclose a one-dimensional micro-cavity comprising colloidal CdSe/ZnS core/shell quantum dots. The quantum dots are embedded in poly-vinylcarbazole.

Ai-Wei Tang et al. in 'White light emission from organic-inorganic heterostructure devices by using CdSe quantum dots as emitting layer', Journal of Luminescence, 122-123, 2007, pages 649-651, discloses an organic-inorganic heterostructure device comprising CdSe quantum dots obtained through colloidal synthesis. The quantum dots were isolated and washed prior to spin coating the quantum dots solution onto a spin-coated PEDOT:PSS layer.

However, it has been found that the processing steps required to manufacture the prior art quantum dot-based devices can have a detrimental effect on the luminescent properties of the quantum dots, for instance because the processing steps expose the quantum dots to detrimental environmental conditions, e.g. extreme temperatures.

The present invention seeks to provide an improved method of manufacturing a luminescent optical element.

The present invention further seeks to provide an improved luminescent optical element.

According to a first aspect of the present invention, there is provided a method of manufacturing a luminescent optical component, comprising providing a substrate, forming a conduit through the substrate, bonding a first surface of the substrate to a transparent carrier, filling the conduit with a luminescent solution and bonding a further surface of the substrate to a further transparent carrier, said further surface being opposite to the first surface.

Hence, a luminescent element is provided that comprises luminescent material in solution, e.g. a colloidal solution of semiconductor quantum dots, thus avoiding the need to isolate the luminescent material and deposit the material onto a layer of the luminescent element, thereby reducing the number of process steps and the risk of exposure of the luminescent material to adverse process conditions such as extreme temperatures. Moreover, the method provides to provide an optical component for a solvent-based luminescent material such as colloidal quantum dots, which means that the luminescent material may be more easily obtained, i.e. no further processing steps are required to isolate the luminescent material.

Preferably, the transparent carriers are direct bonded to the substrate. To this end, the contact surfaces of the transparent carriers and the surface should be sufficiently smooth to allow an intimate contact between the contact surfaces. The surfaces are subsequently exposed to an elevated temperature to promote the formation of bonds between the contact surfaces, thereby directly bonding the two surfaces as for instance is explained in US patent application No. 2005/0082554 A1. Care is taken that the direct bonding of the further surface of the substrate to the further transparent carrier is performed at an elevated temperature that is low enough to avoid significant deterioration of the luminescent solution.

In an embodiment, the step of forming a conduit comprises forming a cavity in the first surface, bonding the first surface to the transparent carrier and exposing the cavity by treating the further surface, said treatment comprising partial removal of the substrate. This has the advantage that the risk of accidental damage to the substrate during the formation of the conduit is reduced. The treatment step may comprise thinning the substrate at the further surface, e.g. by polishing or milling.

The method may further comprise depositing a liner in the conduit for increasing the attractive interaction between the solution and the conduit walls prior to filling the conduit with the luminescent solution. This has the advantage that spreading of the solution is reduced, which facilitates an improved bonding between the further surface and the further transparent carrier. This is particularly advantageous when the further surface is direct bonded to the further transparent carrier at a relatively low temperature to protect the luminescent solution because the liner ensures that the risk of spreading of the solution over the further surface is reduced, thus increasing the quality of the bonding between the further surface and the further transparent carrier.

To this end, the step of filling the cavity with the luminescent solution may comprise retaining a head space over the luminescent solution. Not only does this allowing thermal expansion of the luminescent solution, e.g. during the subsequent bonding step of the further surface and the further transparent carrier, but is also further reduces the risk of the solution spreading over the further surface.

In an embodiment, the conduit comprises a stepped profile. This has the advantage that if the luminescent component is placed in an orientation such that the light path through the conduit is horizontal, any gaseous fluid in the conduit such as air will be trapped in an upper step of the step profile, outside the optical path. This is particularly advantageous when the conduit is filled with the luminescent solution such that a head space is retained, because the head space will be confined to the upper step in his case.

According to a further aspect of the present invention, there is provided a luminescent component comprising a first transparent carrier, a second transparent carrier, a substrate sandwiched between said transparent carriers, the substrate comprising a conduit from the first transparent layer to the second transparent carrier, the conduit being filled with a luminescent solution. Such a luminescent component can be easily integrated in a luminescent device such as a solid state lighting device or a display device, and may benefit from an improved quality of active luminescent component, e.g. a colloidal solution of quantum dots.

Figure 2:
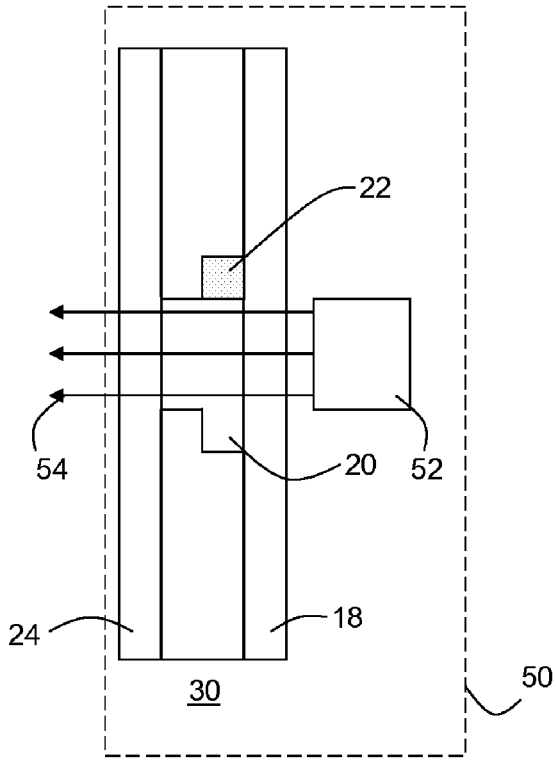
Figure 3:
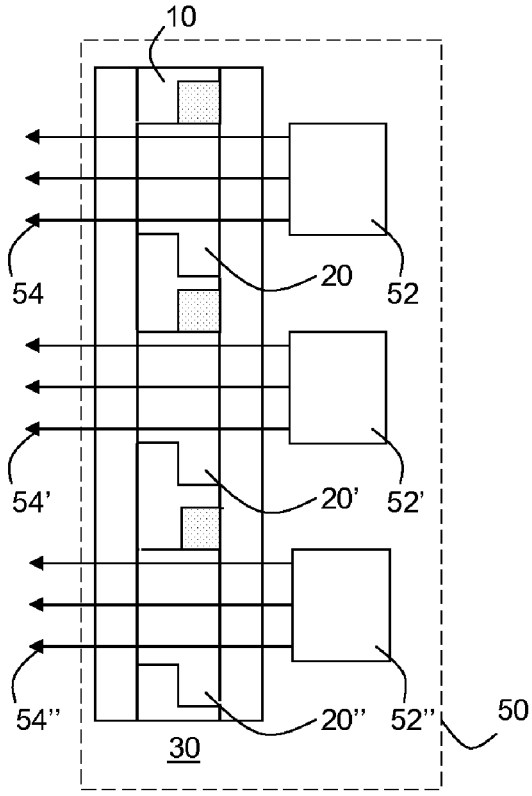

Embodiments of the invention are described in more detail and by way of non-limiting examples with reference to the accompanying drawings, wherein FIG. 1A-F schematically depicts an embodiment of the method of the present invention;

FIG. 2 schematically depicts an embodiment of a luminescent device of the present invention;

FIG. 3 schematically depicts an alternative embodiment of a luminescent device of the present invention; and FIG. 4A-E schematically depicts an alternative embodiment of the method of the present invention.

It should be understood that the Figures are merely schematic and are not drawn to scale. It should also be understood that the same reference numerals are used throughout the Figures to indicate the same or similar parts.

Figure 1B:
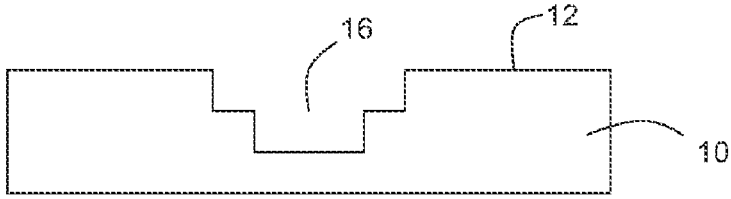

A first embodiment of a method for manufacturing a luminescent component is shown in FIG. 1A-F. FIG. 1A depicts a cross-section of a substrate 10 having a first surface 12 and an opposite surface 14. The substrate may be a silicon wafer or any other suitable substrate. As depicted in FIG. 1B, a cavity 16 is formed in the first surface 12 of the substrate 10. The cavity 16 may be formed by any suitable process, e.g. milling, dry etching, wet etching and so on. The cavity 16 may have any suitable shape, e.g. a cylindrical shape or a cube shape. In an embodiment, at least one side wall of the cavity 16 comprises a stepped profile. Since the formation of stepped profiles in wafers such as silicon wafers is a routine skill for the skilled practitioner, the formation of such a profile will not be further explained for reasons of brevity only.

Figure 1C:
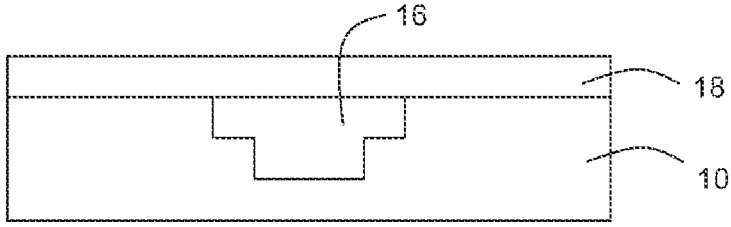

In a next step, shown in FIG. 1C, a first transparent carrier 18 is bonded to the first surface 12, thereby sealing the cavity 16. The first transparent carrier 18 may be a glass wafer or another suitable carrier. To facilitate the bonding step, the first surface 12 and the surface of the first transparent carrier 18 are conditioned in order to achieve a good quality contact between the surfaces. This conditioning step may include cleaning the surfaces with a cleaning fluid, i.e. a wet chemical treatment, chemically or mechanically polishing the surfaces, as well as other suitable conditioning techniques, such as dry or plasma treatments. Several different cleaning techniques may be combined in such a conditioning step. Preferably, the first surface 12 is directly bonded to the first transparent carrier 18, e.g. using direct wafer bonding techniques.

To this end, the first surface 12 is brought into intimate contact with the first transparent carrier 18, after which the substrate stack is exposed to an elevated temperature to bind the first surface 12 to the first transparent carrier 18. During such a direct bonding step, migration of atoms, ions or molecules across the interface between the first surface 12 is and the first transparent carrier 18 cause the formation of bonds across the interface, which for instance may be Van Der Waals-type or electrostatic bonds. Direct bonding is also known as anodic bonding.

Direct bonding is preferred because it can be readily applied to perforated substrates, whereas other bonding techniques, e.g. adhesive bonding are more involved because the application of an adhesive is not straightforward. Spillage of the adhesive into the cavities of the substrate 10 must for instance be avoided. However, it is pointed out that other bonding techniques such as adhesive bonding may be considered as an alternative to direct bonding.

Figure 1D:
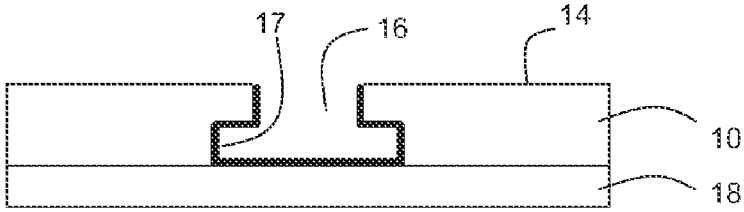

Next, as shown in FIG. 1D, the opposite surface 16 of the substrate 10 is subjected to a thinning step in order to expose the cavity 16. Such a thinning step may be performed in any suitable way, e.g. etching, milling or chemical polishing or mechanical polishing. The exposure of the cavity 16 creates a conduit through the substrate 10, which may be utilized as an optical path, i.e. light path, as will be explained in more detail later.

Prior to filling the cavity 16 with a luminescent solution, the opposite surface 14 is also conditioned to facilitate an intimate contact with a conditioned surface of a further transparent layer. The cavity 16 may also be lined with a liner 17 to increase the attractive interaction between the luminescent solution and the 5 walls of the cavity 16. In case of a hydrophilic luminescent solution, e.g. a waterbased solution, non-limiting examples of suitable liners include silicon oxides, silicon nitrides and silicones.

Figure 1E:
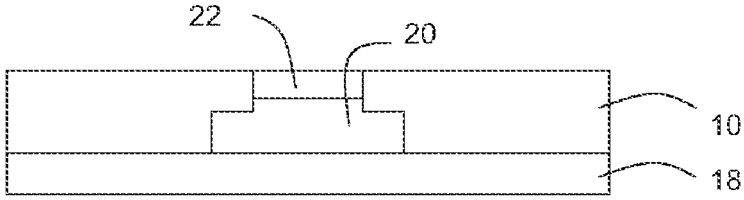
Figure 1F:
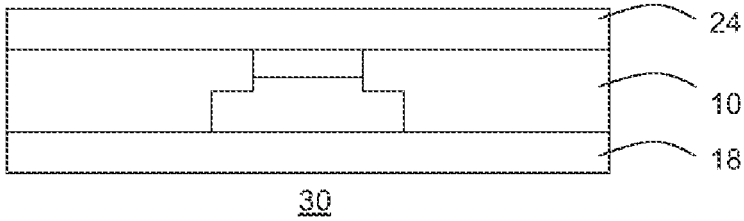

FIG. 1E depicts how the cavity 16 is subsequently filled with a luminescent solution 20. Preferably, the luminescent solution 20 is a colloidal solution of semiconductor quantum dots such as Cd/Se quantum dots, because such solutions have particularly promising luminescent properties. For instance, by varying the size of the Cd/Se quantum dots, the spectral range of the light emitted by the quantum dots may be tuned. Also, the quality of the quantum dots can be sensitive to further processing steps in the manufacture of a luminescent component, as previously explained, which is why the present invention is particularly advantageous to quantum dot based solutions. However, it will be appreciated that the present invention is not necessarily limited to solutions comprising Cd/Se quantum dots. Solutions comprising other types of luminescent quantum dots are equally feasible. Solutions comprising other types of luminescent components may also be used.

Preferably, the cavity 16 is filled with the luminescent solution 20 such that a head space 22 remains over the luminescent solution 20. Not only does this reduce the risk of accidental spilling of the luminescent solution 20 over the further surface 14, but it also provides a thermal expansion volume for the luminescent solution 20 when the optical component is exposed to an elevated temperature, e.g. during a subsequent direct bonding step, as will be explained in more detail later.

In this context, a stepped profile on the walls of the cavity 16 is advantageous because it facilitates the formation of a head space having a relatively small volume in the narrow part of the cavity 16.

It is important that the luminescent solution 20 does not spread over the further surface 14, because this can have a detrimental impact on the subsequent bonding of the further surface 14 to a further transparent carrier. Such spreading, or smearing, may for instance occur when a further transparent 5 carrier is moved across the further surface 14 in a sliding fashion, thereby touching the meniscus of the luminescent solution 20. As previously explained, this risk may be reduced by lining the walls of cavity 16 with a liner, e.g. a lining film (in reference to FIG. 1D with respect to the liner 17), which increases the attractive forces between the luminescent solution 20 and the walls of the cavity 16, such that the luminescent solution resists smearing 10 over the further surface 14.

The method is completed by covering the further surface 14 of the substrate 10 with a further transparent carrier 24, e.g. a glass wafer, and bonding the further transparent carrier 24 to the further surface 14, thereby yielding the luminescent component 30. Preferably, these surfaces are directly bonded by exposing the substrate stack to an elevated temperature. In an embodiment, the elevated temperature of this direct bonding step is lower than the elevated temperature of the direct bonding step binding the first surface 12 and the first transparent carrier 18. For instance, in order to avoid thermal degradation of the solution 20, the direct bonding step may be executed between 0°-100° C. Preferably, this temperature is chosen between 20°-85° C. to further reduce the risk of such degradation and ensure a sufficiently strong direct bonding between the contact surfaces. Preferably, the further surface 14 and the further transparent carrier 24 are conditioned by means of a plasma treatment, because it has been found that such a treatment ensures that the surfaces are sufficiently strongly bonded even at room temperature (i.e. 20° C.).

It is pointed out that when using direct bonding, it is preferred that the substrate 10 is a silicon wafer and the transparent carriers 18 and 24 are glass, because a silicon-glass interface can be strongly bonded using direct bonding techniques.

The luminescent module 30 may be integrated in a luminescent device 50, as shown in FIG. 2. The luminescent device 50 comprises a light source 52, which may be any suitable light source, e.g. a solid state light source such as a light emitting diode based light source. The light source 52 is arranged to irradiate the luminescent solution 20 with light of a predefined wavelength, e.g. ultraviolet (UV) light, which brings the luminescent material, e.g. the quantum dots, in an excited state, causing the material to emit light 54. The light 54 typically has a spectral range governed by the properties of the luminescent material, e.g. the dimensions and the materials of the quantum dots. As shown in FIG. 2, when the cavity 16 of the luminescent component comprises a stepped profile, any gaseous fluid in the cavity 16 such as head space 22 will be confined to one of the steps of the stepped profile when the conduit of the luminescent component 30 is oriented horizontally, thereby ensuring that the head space 22 does not interfere with the optical path through the conduit.

It will be appreciated that any cavity wall profile facilitating the location of the head space 22 outside a horizontally oriented optical path may be chosen instead of a stepped profile.

It is emphasized that the luminescent device 50 may comprise a luminescent module 30 comprising multiple conduits, e.g. an array or matrix of luminescent module 30. An example of such a luminescent device is shown in FIG. 3, which comprises three light sources 52, 52' and 52", and three conduits filled with three luminescent solutions 20, 20' and 20". The luminescent solutions 20, 20' and 20" may be the same solutions or may be different solutions, e.g. solutions comprising differently sized quantum dots, in which case the luminescent solutions 20, 20' and 20" respectively emit light 54, 54' and 54" having different spectral ranges. In FIG. 3, a single luminescent module 30 comprising multiple conduits is shown. It will be appreciated that as an alternative, multiple luminescent modules 30 having a single conduit may also be used. The luminescent device 50 may be a solid state lighting device, a display device or any other device for emitting light in a predefined spectral range.

The method for manufacturing an luminescent component 30 as shown in FIG. 1A-F is particularly advantageous because the two-step manufacturing process of the conduit by first forming a cavity 16 in the first surface 12 and subsequently exposing the cavity 16 through treating the opposite surface 14 reduces the risk of accidental damage to the substrate 10. However, the method may be simplified at the cost of a potential increase in the risk of damage to the substrate 10. This simplified method is shown in FIG. 4A-E.

Figure 4A:
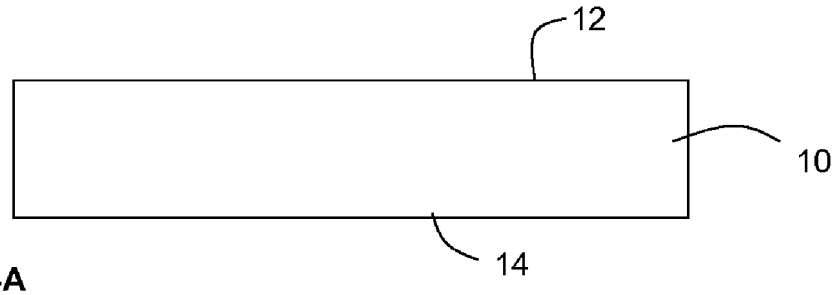
Figure 4B:
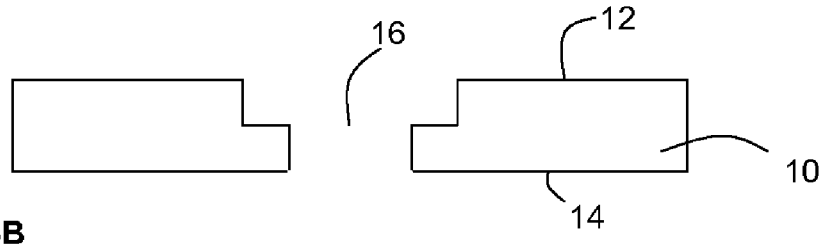
Figure 4C:
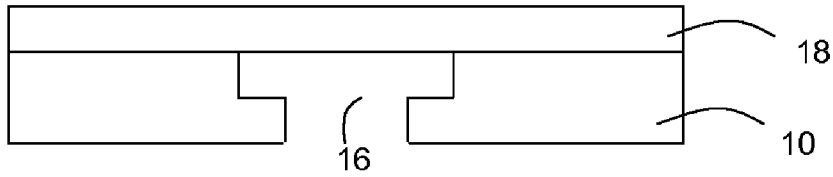
Figure 4D:
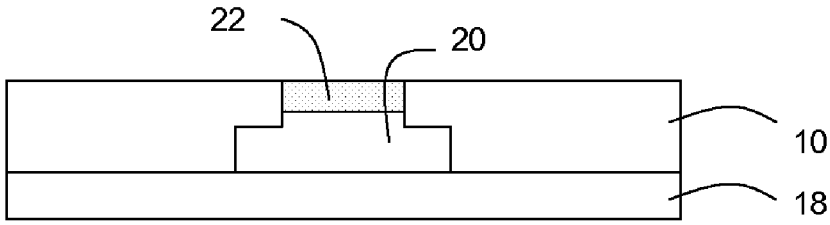
Figure 4E:
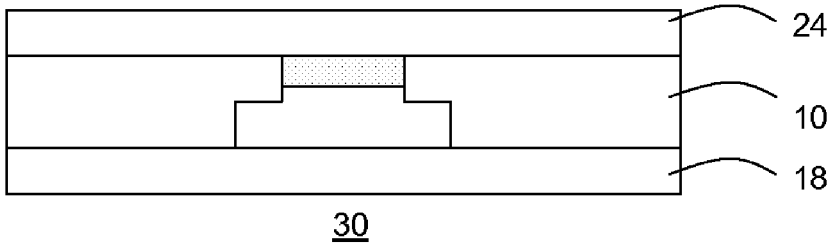

In FIG. 4A, a substrate such as a silicon wafer is provided. In FIG. 4B, the cavity 16 is formed in the first surface 12 of the substrate 10, but this cavity 16 is formed through the full thickness of the substrate 10. Hence, the conduit is immediately formed. Next, the first transparent carrier 18 is bonded to the first surface 12, e.g. by means of direct bonding as previously explained, and the cavity 16 is filled with the luminescent solution 20, optionally leaving a head space 22. The cavity 16 may be lined with a liner prior to filling the cavity 16, as previously explained. The luminescent component 30 is completed by bonding the further transparent carrier 24 to the opposite surface 14, e.g. by direct bonding, as previously explained.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The mere fact that certain measures are recited in mutually different dependent claims does not indicate that a combination of these measures cannot be used to advantage.

The invention claimed is:

1. A method of manufacturing a luminescent component, comprising:

providing a substrate;

forming a conduit extending into a first surface of the substrate;

bonding the first surface of the substrate to a transparent carrier;

after bonding the first surface, filling the conduit with a luminescent solution; and bonding a further surface of the substrate to a further transparent carrier, said further surface being opposite to the first surface.

2. A method according to claim 1, wherein the step of forming a conduit comprises:

forming a cavity in the first surface;

bonding the first surface to the transparent carrier; and exposing the cavity by treating the further surface, said treatment comprising partial removal of the substrate.

3. A method according to claim 2, wherein the treatment step comprises thinning the substrate at the further surface.

4. A method according to claim 1, wherein the conduit comprises a stepped profile.

5. A method according to claim 1, further comprising depositing a liner in the conduit prior to filling the conduit for increasing the attractive interaction between the luminescent solution and the conduit walls.

6. A method according to claim 1, wherein at least one of the bonding steps comprises a direct bonding step.

7. A method according to claim 6, wherein the step of bonding the further surface to a further transparent carrier comprises a direct bonding step operated at a lower temperature than the bonding of the first surface of the substrate to the transparent carrier.

8. A method according to claim 1, wherein the luminescent solution is a colloidal solution comprising semiconductor quantum dots.

9. A method according to claim 1, wherein the step of filling the conduit with the luminescent solution comprises retaining a head space over the luminescent solution for allowing thermal expansion of the luminescent solution.

10. The method of claim 1, further including depositing a liner in the conduit prior to filing the conduit, wherein filling the conduit includes filling the conduit with quantum dots.

11. The method of claim 1, wherein forming a conduit includes forming a cavity in the first surface of the substrate, extending partially into the substrate and terminating before reaching the further surface of the substrate, wherein bonding the first surface of the substrate to the transparent carrier includes sealing the cavity with the transparent carrier, further including removing a portion of the substrate to form an opening extending from the further surface of the substrate and into the cavity, prior to filling the conduit with the luminescent solution, wherein filling the conduit with a luminescent solution includes filling the conduit via the opening extending from the further surface of the substrate, partially filling the conduit, leaving a portion of the conduit adjacent the first surface unfilled, and wherein bonding the further surface of the substrate includes bonding the further surface to the further transparent carrier, after filling the conduit with the luminescent solution, the further transparent carrier being immediately adjacent and sealing the unfilled portion of the conduit.

* * * * *